United States Patent [19]

Doi et al.

[11] 4,060,320

[45] Nov. 29, 1977

[54] TRANSFER MATERIAL SEPARATING DEVICE

[75] Inventors: Yasuhiko Doi, Toyokawa; Yukio Tokura, Toyohashi; Koji Imaizumi, Aichi, all of Japan

[73] Assignee: Minolta Camera Kabushiki Kaisha, Osaka, Japan

[21] Appl. No.: 645,293

[22] Filed: Dec. 29, 1975

[30] Foreign Application Priority Data

Jan. 8, 1975 Japan ..... 50-5708[U]
Jan. 14, 1975 Japan ..... 50-7222[U]

[51] Int. Cl.[2] ..... G03G 15/00
[52] U.S. Cl. ..... 355/3 R; 271/DIG. 2; 271/174
[58] Field of Search ..... 355/3 R, 3 TR, 3 DR, 355/11, 8, 14, 3 TE; 271/80, 174, DIG. 2; 118/245; 100/174; 34/120

[56] References Cited

U.S. PATENT DOCUMENTS 3,450,402 6/1969 Weiler ..... 271/80
3,991,999 11/1976 Brooke ..... 271/DIG. 2

OTHER PUBLICATIONS

"Electrophotographic Cleaning Apparatus", IBM Technical Disclosure Bulletin, Apr. 1970, p. 1819.

*Primary Examiner*—George H. Miller, Jr.
*Assistant Examiner*—W. J. Brady
*Attorney, Agent, or Firm*—Wenderoth, Lind & Ponack

[57] ABSTRACT

A transfer material or copy paper separating device for use in an electrophotographic copying apparatus which includes a driving mechanism for the transfer material, separating claws adapted to pivotally contact or be spaced away from a photoreceptor surface in timed relation to the movement of the copy paper. Each of the separating claws is formed from a flexible elastic film of polyester or the like and has very short fibers, for example, of nylon, on at least front edge portion thereof, contacting the photoreceptor surface for reducing damage to the photoreceptor surface.

12 Claims, 8 Drawing Figures

TRANSFER MATERIAL SEPARATING DEVICE

The present invention relates to a transfer material separating device, and more particularly, to a transfer material separating device for use in an electrophotographic copying apparatus.

BACKGROUND OF THE INVENTION

Commonly, an electrophotographic copying appararus of transfer type includes a photoreceptor, for example, in the configuration of a drum having a photconductive layer or light-receiving surface on a conductive backing therearound and rotatably mounted below a transparent platform for placing an original to be copied thereon, so as to cause the photoconductive photoreceptor surface to sequentially pass various processing stations disposed therearound. These stations include: a corona charging station for preliminarily charging the photoreceptor surface; an exposure station for exposing the thus charged photoreceptor surface to image light of the original directed thereto, an optical system and illuminating light source disposed between the platform and the photoreceptor drum, so as to form an electrostatic latent image of the original on the photoreceptor surface; and a transfer station having a transfer unit for transferring the latent image onto a transfer material or copy paper, either directly or after having been developed into a visible toner image by a developing unit depending on the types of the copying apparatus in a known manner. Some of such copy apparatuses are provided with horizontally, reciprocatingly movable platforms and stationary optical systems, while others have movable optical systems with stationary platforms for scanning the original to be copied in the latent image formation. The transfer material is fed, through transportation rollers, onto the photoreceptor surface having thereon the thus formed latent image and is subsequently presses against the photoreceptor surface by transfer rollers of the transfer unit disposed adjacent to the photoreceptor surface for the latent image transfer. In this case, however, since the copy paper closely adheres to the photoreceptor surface due to electrostatic attraction developed therebetween, it is necessary to separate the copy paper from the photoreceptor surface after transfer.

For effecting the above described copy paper separation, there has conventionally been proposed a separation device in which separation claws are employed. The front edges of the separation claws are directed against the direction of the advancing copy paper to contact the photoreceptor surface for mechanically stripping the copy paper from the photoreceptor surface. This device, however, while simple in construction and compact in size, has such disadvantages that the photoreceptor surface tends to be damaged during repeated use due to the contact of the front edges of the claws with the photoreceptor surface. This not only adversely affects the quality of copied images, but results in short life of the photoreceptor itself. Accordingly, in order to reduce the damage to the photoreceptor surface to a minimum level, the separating claws must be arranged so as to contact the photoreceptor surface only during copy paper separation instead of contacting the same at all times, and the material and shape of such claws must be fully taken into account to minimize the damage to the photoreceptor surface even during the contact thereof with the photoreceptor surface. For meeting such requirements, separating claws of different configuration associated with various operating mechanisms have also been presented some these, the front edge of the claw is made as thin as a doctor's scalpel for increasing the separating effect, thus simultaneously reducing the contact area with respect to the photoreceptor surface, or the claw is movably associated with a cam which rotates in association with the copying operation for causing the same claw to contact the photoreceptor surface in timed relation only during the copy paper separation. Each of these conventional arrangements, however, is not necessarily favourable and still damages the photoreceptor surface, especially in the photoreceptor employed in the latent image transfer type copying apparatus, to such an extend that such arrangements are not suited to practical use.

Another problem encountered when such separating claws are employed in the electrostatic latent image transfer type copying apparatus in the adverse effect on the copied images due to tribo-electrical or frictional charge arising from frictional contact between the separating claws and the copy paper. In other words, since the copy paper used for such latent image transfer type copying apparatus is provided with an insulating dielectric surface layer composed, for example, of polyvinyl acetal, polyurethane, copolymer of vinyl acetate and acrylic ester and the like, frictional charge builds up upon contact of the surface of the copy paper with the under surface of the separating claw during the copy paper separation, and the background portion of the latent image is charged to different polarities depending on the materials of the separating claws. For example, the background has a negative polarity if the material of the claw is of acrylic, polyester or Mylar(commercial name for polyethylene glycol terephthalate film produced by Du Pont), or has a positive polarity if the material of the same is of Teflon(commercial name for polytetrafluoroethylene product by Du Pont) and the like. Accordingly, if the material of the claw is one which charges the background portion of the copy paper with the same polarity as that of the latent image, the portion thus charged by the contact with the claw appears as unsightly contact traces after development. When the copy paper is not picked off the photoreceptor surface immediately after the passage of the grounded transfer roller of the transfer unit, the transfer is effected on the background portion of the latent image wherein no transfer takes place normally, thus resulting in soiling in the background of the copy after developing. This defect is considered to be due to the fact that the charge which builds up in an electroconductive base of the copy paper due to the charge in the background portion of the latent image on the photoreceptor is not sufficiently erased by the grounded roller during separation of the copy paper from the photoreceptor surface. Even when the copy paper is adapted to be forcibly separated from the photoreceptor surface by the separating claw immediately after the passing of the grounded roller for the prevention of the above described disadvantage, the surface of the copy paper tends to strongly contact the under surface of the separating claw, and the above defect becomes all the more conspicuous. Accordingly, when employing copy paper separation claws in an electrostatic latent image transfer type copying apparatus, countermeasures not only for the damage to the photoreceptor surface by the separating claws, but also for the adverse effect on the copied images due to tribo-electrical charge of the separating claws and the copy paper must be taken into consideration.

SUMMARY OF THE INVENTION

An essential object of the present invention is to provide a transfer material separating device for use in an electrophotographic copying apparatus which includes transfer material separating claws that will not damage a photoreceptor surface even after repeated use for a long period of time.

Another important object of the present invention is to provide a transfer material separating device of the above described type wherein portions of the separating claws which contact the photoreceptor surface are formed from flexible elastic material, while portions of the same frictionally contacting the transfer material are formed from material which is tribo-electrically charged with the same polarity as that of an electrostatic latent image formed on the transfer material. This will substantially eliminate the disadvantages inherent in the conventional transfer material separating devices.

A further object of the present invention is to provide a transfer material separating device of the above described type which is accurate in functioning, simple in construction, and is inexpensive to manufacture.

According to a preferred embodiment of the present invention, the transfer material separating device includes at least one transfer material separating claw which is associated with a driving mechanism for pivotal movement so as to be caused to contact the photoreceptor surface for separation of transfer material from the latter and to be spaced away from the photoreceptor surface upon completion of the transfer material separation in timed relation to the transportation of the transfer material onto the photoreceptor surface. Furthermore, for reducing the damage to the photoreceptor surface due to contact of the separating claw therewith, the separating claw is formed of flexible elastic material, such as polyester film, with flock or very short fibers of flexible material, for example, of nylon and the like, filling at least the forward end portion of the claw for close and gentle contact of the claw to the photoreceptor surface. By this arrangement, damage to the photoreceptor surface during repeated use of the separating claw for a long period of time which is inherent in the conventional transfer material separating devices has been advantageously reduced to a minimum.

BRIEF DESCRIPTION OF THE DRAWINGS

These and other objects and features of the present invention will become apparent from the following description taken in conjunction with the preferred embodiments thereof with reference to the attached drawings, in which.

DETAILED DESCRIPTION OF THE INVENTION

Figure 2:
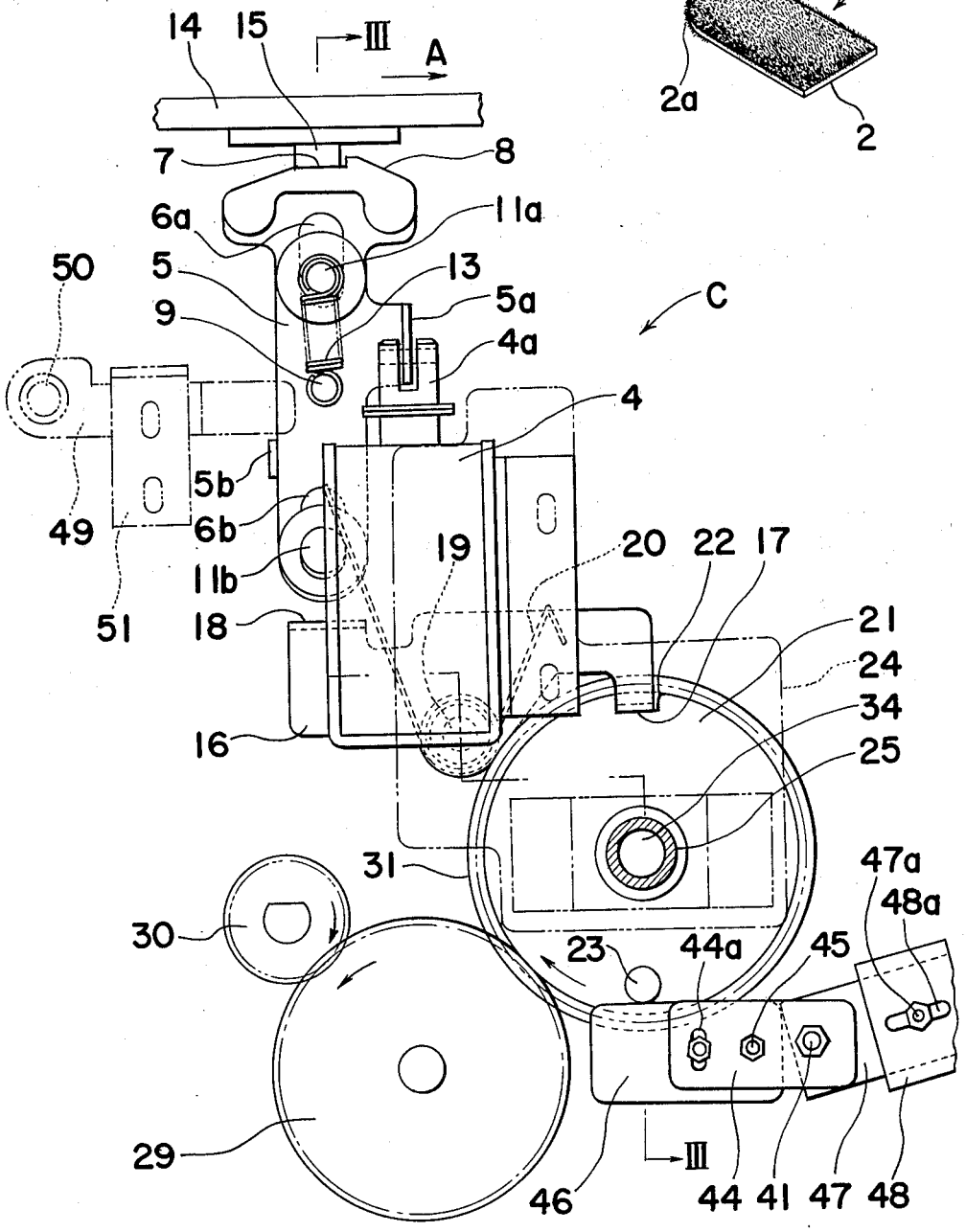
FIG. 2 is a schematic view, partly in section, showing construction of a driving mechanism of the transfer material separating device of the invention.

Before the description of the present invention proceeds, it is to be noted that like parts are designated by like reference numerals throughout several views of the attached drawings.

Figure 1:
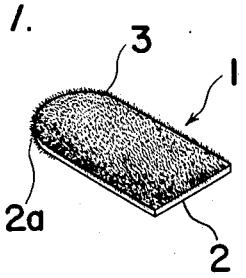
FIG. 1 is a perspective view, on an enlarged scale, showing a transfer material separating claw incorporated in a transfer material separating device according to the present invention.
Figure 3:
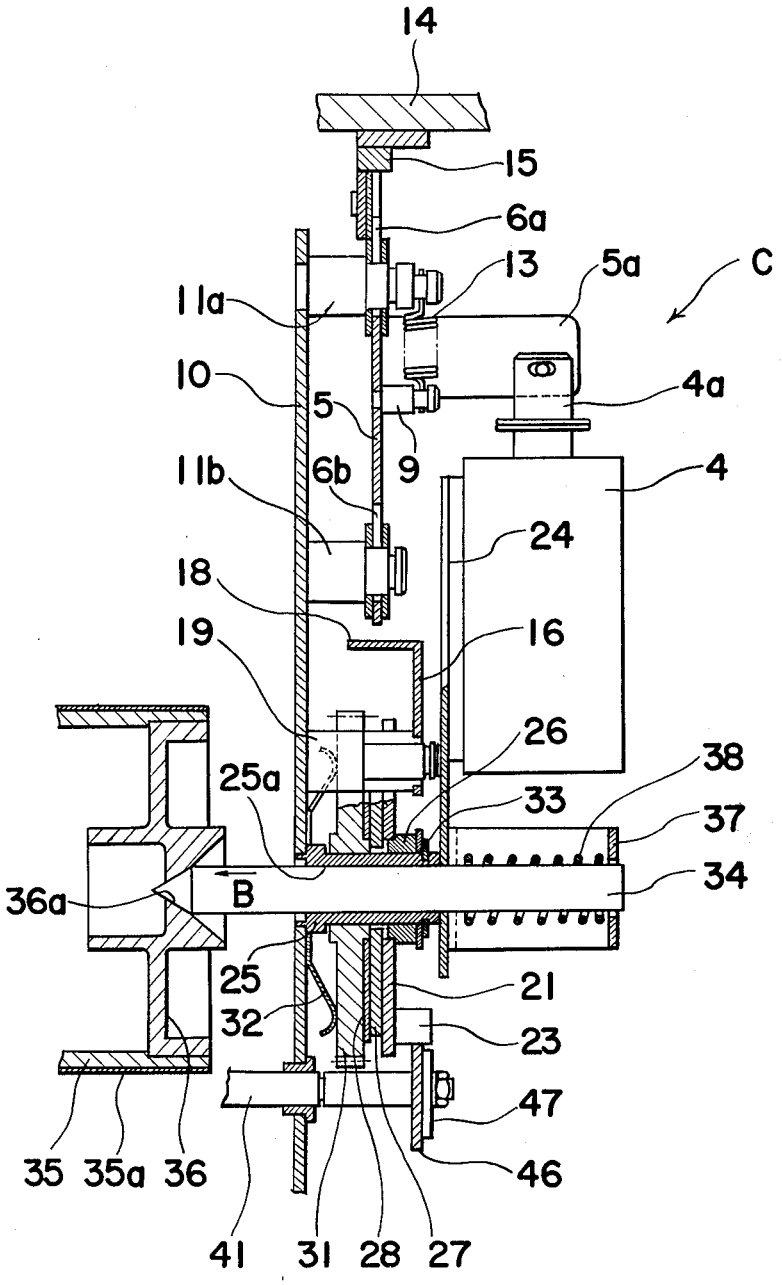
FIG. 3 is a cross sectional view taken along the line III — II of FIG. 2.

Referring to FIG. 1, there is shown a transfer material separating claw incorporated in the transfer material separating device of the invention. The separating claw 1 is made of a flexible elastic film 2, for example of polyester, having a rectangular plate-like configuration, with one end 2*a* thereof being formed into a semi-circular shape. Flock or very short fibers 3 of flexible material such as nylon or polyester are filled on the entire upper surface of the film 2 and the extreme tip of the semi-circular end 2*a* of the claw 1. The filling of the very short fibers 3 onto the film 2 is effected by the so-called electrostatic flocking method in which the polyester film 2 and the fibers 3 are charged with opposite polarities to each other for causing the fibers 3 to adhere to the surface of the film 2 applied with suitable adhesive.

It should be noted that the material for the claw 1 is not limited to the polyester film, but any other flexible elastic material may be employed for the purpose, and that the very short fibers 3 of nylon or polyester described as employed in the claw 1 of FIG. 1 may also be replaced by short fibers of other flexible material.

It should also be noted that the flocking described as effected on the entire upper surface of the polyester film 2 may be limited only to the semi-circular end portion 2*a* of the film 2, at least to the extreme tip and part of the upper surface of the end portion 2*a*, and the filling method is not limited to the electrostatic flocking described with reference to FIG. 1, but any other known method may be employed for the purpose.

Referring now to FIGS. 2 to 6, there is shown a mechanism C(FIGS. 2 and 3) for driving the claw 1 in association with the copying operation. The driving mechanism C mainly includes a platform stop lever 5 which is operated by a solenoid 4 and displaceably disposed in a direction normal to the surface of a platform 14 horizontally, reciprocatingly supported at an upper portion of a copying apparatus housing (not shown). A circular cam plate 21 is rotatably provided below and adjacent to the solenoid 4 and has a notch 22 formed in the outer periphery thereof. A cam plate releasing lever 16 is pivotally disposed adjacent to the cam plate 21 for selectively causing the cam plate to stop and rotate in association with the movement of the stop lever 5, and a first adjusting plate 46 is pivotally disposed below and adjacent to the cam plate 21 for engagement with an actuator pin 23 extending outwardly from the surface of the cam plate 21. Finally, a claw shaft 41 has the claw 1 fixedly mounted thereon and is associated for pivotal movement with the adjusting plate 46.

The stop lever 5 has a right-angled projection 5*a* at one side edge thereof which is suitably connected to a plunger 4*a* of the solenoid 4. Elongated openings 6*a* and 6*b* are formed in the lever 5 along the vertical axis thereof, and in these openings 6*a* and 6*b*, guide pins 11*a* and 11*b* secured to a frame 10 of the apparatus housing(-not shown) are slidably received for allowing the lever 5 to move upward or downward therebetween. The lever 5 is normally urged upward by a tension spring 13 stretched between the guide pin 11*a* and a pin 9 fixed to a central portion of the lever 5. The stop lever 5 is further formed with a stepped portion 7 and a scarfed or inclined portion 8 at the uppermost portion thereof for limiting the scanning of the platform 14 in the direction of an arrow A in FIG. 2 upon engagement of a stop member 15 secured to the lower surface of the platform 14 with the stepped portion 7 of the lever 5. Another right-angled projection 5*b* is formed at the other side edge of the lever 5. A stop lever releasing arm 49(FIG. 2), which is pivotally supported at one end thereof by a pin 50 secured to a frame(not shown) of the apparatus housing(not shown) and which is provided with a stop lever releasing lever releasing lever 51 at the central portion thereof, is disposed adjacent to the stop lever 5, the other end of the arm 49 being located above the projection 5*b* of the stop lever 5. By depressing the lever 51, the arm 49 is rotated clockwise about the pin 50 to lover the stop lever 5 and consequently release the positioning of the platform 14 through disengagement of the stop member 15 of the platform 14 from the stepped portion 7 of the stop lever 5. Accordingly, the platform 14 is freed at any time by mere depression of the lever 51 of the arm 49.

On the other hand, the cam plate releasing lever 16 is pivotally supported at the control portion thereof by a shaft 19 secured to the frame 10 and is normally urged clockwise by a wire spring 20 which is passed around the shaft 19 at its central portion. One end of the spring 20 is engaged with a right upper edge of the lever 16 in FIG. 2, while the other end of the spring 20 is engaged with the outer periphery of the guide pin 11*b* for the stop lever 5. The releasing lever 16 is so arranged that when a stopping member 17 formed at one end thereof engages the notch 22 formed in the outer periphery of the cam plate 21 mentioned more in detail later, further rotation of the cam plate 21 is prevented. When the lower end of the stop lever 5 contacts the surface of a right angled projection 18 formed at an upper edge of the other end of the lever 16, the lever 16 is turned counterclockwise to a certain extent about the shaft 19, thus resulting in the subsequent disengagement of the stopping member 17 from the notch 22 for permitting the cam plate 21 to rotate.

The cam plate 21 is rotatably disposed, through a collar 26, on a boss member 25 provided on the same axis as that of a photoreceptor drum 35 in a position between the frame 10 and a frame 24 for supporting the solenoid 4. On the boss member 25, there are further mounted a gear 31 which is connected to a timing gear 30 through a friction member 27, friction plate 28 and an idle gear 29, and a dish-shaped spring 32 is disposed between the frame 10 and the gear 31. The cam plate 21 is retained, through the collar 26, by a retaining ring 33 so as to press the cam plate 21, the friction member 27, the friction plate 28 nd the gear 31 against each other for simultaneous rotation. A shaft 34 is inserted into a central bore 25*a* of the boss member 25. And has one end thereof extending into a tapered hole 36*a* formed in a flange 36 of the photoreceptor drum 35. The other end of the shaft 34 is normally urged in a direction shown by an arrow B(FIG. 3) by a coil spring 38 housed in a holder 37 secured to the frame 24 to which the solenoid 4 is fixed.

Figure 4:
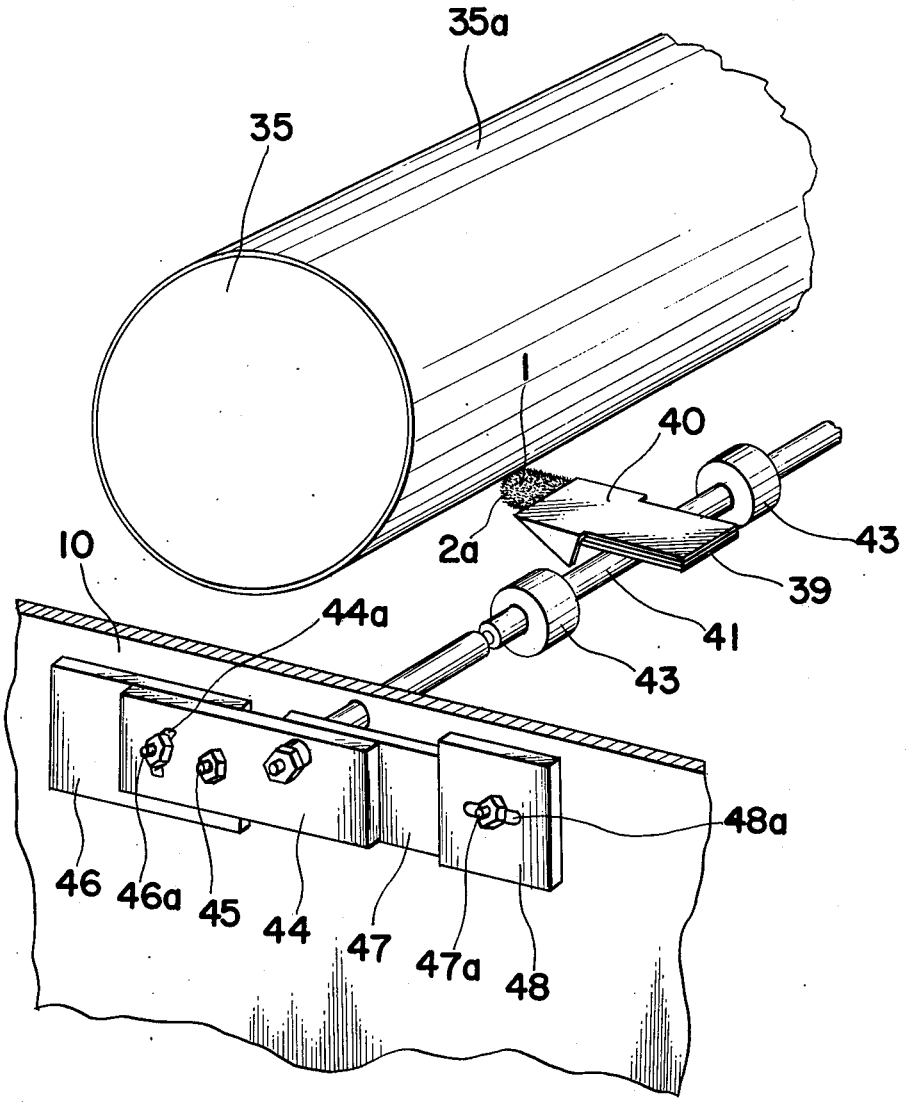
FIG. 4 is a perspective view, partly broken away, showing an essential portion of the device of FIG. 2.
Figure 5:
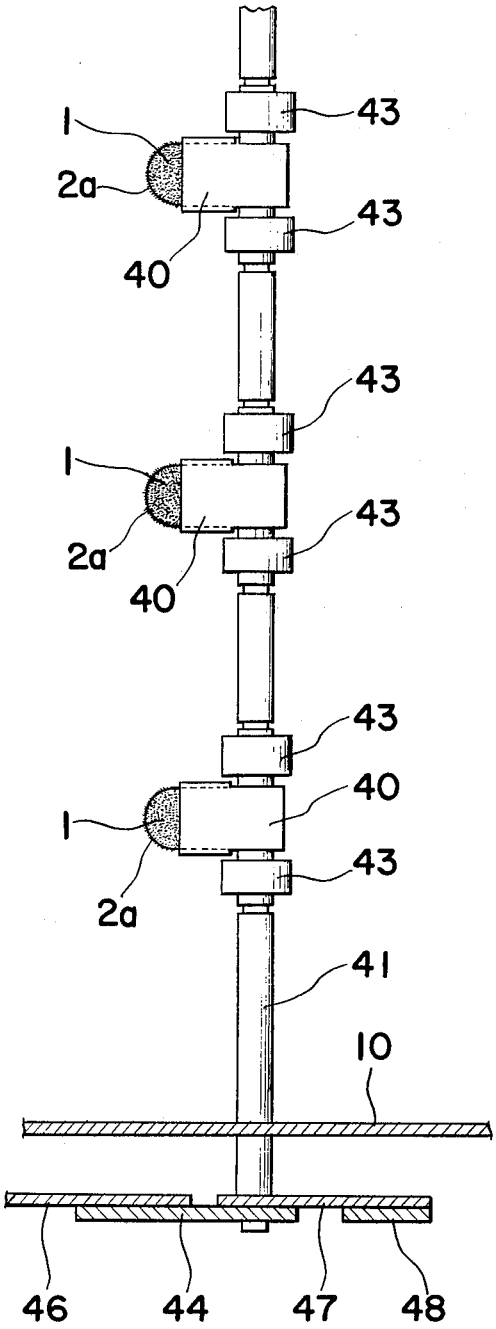
FIG. 5 is a top plan view, partly broken away and in section, of the portion of FIG. 4.
Figure 6:
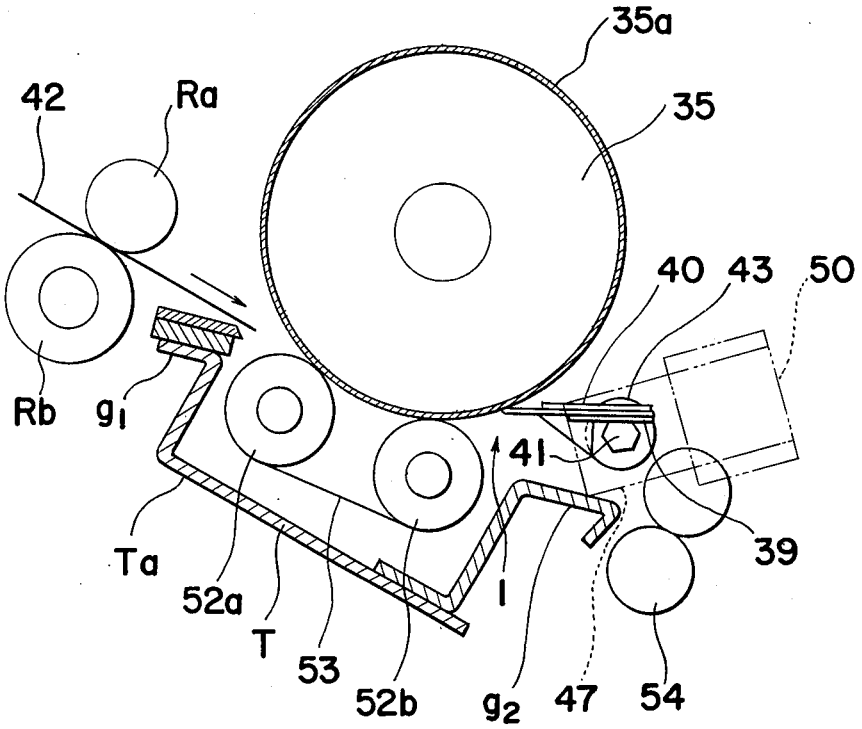
FIG. 6 is a schematic sectional side view showing the relationship between the separating claw of the device of the invention and a photoreceptor drum together with a transfer unit associated therewith.

Referring particularly to FIGS. 4 and 5, three separating claws 1 are mounted on a shaft 41. Each of the claws 1 is tightly held, at the rear portion thereof, between a plate spring 39 and a guide plate 40 suitably secured to the shaft 41 rotatably supported by the frame 10. The semi-circular front portions 2*a* of each of the claws 1 are arranged in parallel, to each other on the shaft 41 and are directed toward the photoreceptor surface 35*a* formed around the photoreceptor drum 35. These front portions face against the direction of advance of a transfer material or copy paper 42(FIG. 6). A plurality of pairs of spaced guide rollers 43 for the copy paper 42 are rotatably mounted on the shaft 41, with each of the guide plates 40 for the claws 1 being positioned between each pair of rollers 43. At one end of the shaft 41, a second adjusting plate 44 and a balancing weight mounting plate 47 of rectangular configuration are each fixedly mounted at one end thereof, while the first adjusting plate 46 earlier mentioned is pivotally supported by the plate 44 by a threaded pin 45 and a nut. A threaded pin 46*a* secured on the first adjusting plate 46 is slidably received in an arcuate opening 44*a* formed in the plate 44 for permitting the positioning of the first adjusting plate 46 about the pin 45 through tightening of a nut for the pin 46*a*. Adjacent to the other end of the balancing weight mounting plate 47, a balancing weight 48 of square shape is laterally, displaceably mounted. A threaded pin 47*a* is secured on the plate 47 and is slidably received in an elongated opening 48*a* laterally formed in the balancing weight 48 so as to permit positioning of the weight 48 through adjustments of a nut for the pin 47*a*. By this arrangement, the shaft 41 and consequently the claws 1 are normally urged clockwise by the weight of the balancing weight 48 and are limited for further clockwise rotation by the contact of the upper edge of the first adjusting plate 46 with the actuator pin 23 earlier mentioned extending outwardly at right angles from the surface of the cam plate 21.

Referring particularly to FIG. 6, the photoreceptor drum 35 suitably grounded and rotatably mounted below the platform 14(not shown) in the copying apparatus housing(not shown) has the photoreceptor surface 35*a*, for example, of N type therearound composed of an inorganic photoconductive layer, such as a selenium alloy layer or of organic photoconductive layer, such as a polyvinyl carbazole layer. The transfer material 42 having a resinous surface layer of high electrical resistance is fed between the transfer unit T disposed adjacent to the photoreceptor drum 35 and the photoreceptor surface 35*a* through feeding rollers Ra and Rb. The transfer unit T includes a transfer frame Ta having guide portions $g_1$ and $g_2$ which face the photoreceptor surface 35*a* and incorporates therein a roller 52*a*, for example, an insulating sponge roller for preventing excessively rapid transfer, another rotatable roller 52*b*, for example, an electrically conductive sponge roller of flexible material suitably grounded for the latent image transfer and a plurality of narrow insulating belts 53 movably supported, in contact with the photoreceptor surface 35*a*, by the rollers 52*a* and 52*b*. The separating claws 1 of the separating device of the invention are pivotally disposed subsequent to the transfer unit T adjacent to the photoreceptor surface 35*a* for separating the copy paper 42 after transfer from the photoreceptor surface 35*a*. The copy paper 42 thus separated in fed into any subsequent devices, such as a developing device(not shown) through the transportation rollers 54.

In the foregoing arrangement, the stopping member 17 of the releasing lever 16 is normally engaged with the notch 22 of the cam plate 21 for positioning of said cam plate 21, while the separating claws 1 are so positioned that the same are spaced to a certain extent from the photoreceptor surface 35*a* of the drum 35 without contacting the latter, and the first adjusting plate 46 engages the actuator pin 23 of the cam plate 21.

Upon turning on a print switch(not shown), the photoreceptor drum 33 is rotated through corona charging and exposure to form the electrostatic latent image of an original(not shown) on its photoreceptor surface 35*a*. The copy paper 42(FIG. 6) is fed in sychronization with the rotation of the drum 35. The copy paper thus fed is pressed against the photoreceptor surface 35*a* of the drum 35, in the transfer unit T(FIG. 6) disposed adjacent to the drum 35, by the belt 53 movably supported by the rollers 52*a* and 52*b* for sequentially transferring the latent image formed on the photoreceptor surface 35*a* onto the copy paper 42. The actuation of the print switch(not shown) simultaneously energizes the solenoid 4 for lowering the platform stop lever 5 so as to disengage the stepped portion 7 of the stop lever 5 from the stop member 15 of the platform 14, thus causing the platform 14 to start scanning in the direction of the arrow A(FIG. 2). Simultaneously, upon descent of the stop lever 5, the projection 18 of the releasing lever 16 is depressed by the lower ends of the lever 5, and the lever 16 is turned counterclockwise to a certain extent about the pin 19 against the urging force of the wire spring 20 for disengaging the stop member 17 of the lever 16 from the notch 22 of the cam plate 21. Furthermore, upon turning on of the print switch (not shown), the gear 31 is driven through the timing gear 30 and the idle gear 29 in which case, while the stop member 17 of the lever 16 is engaged with the notch 22 of the cam plate 21, the rotation of the gear 31 is not transmitted to the cam plate 21 due to slipping of the friction member 27 and the friction plate 28. When the stop member 17 is disengaged from the notch 22 through rotation of the lever 16 in the above described manner, the rotation of the gear 31 is transmitted, through the friction member 27 and the friction plate 28, to the cam plate 21 for causing the latter to start rotating clockwise. Upon rotation of the cam plate 21, the second adjusting plate 46 is released from engagement with the actuator pin 23 of the cam plate 21 and is subsequently turned clockwise to a certain extent together with the shaft 41 and the claws 1 by the weight of the balancing weight 48, with each of the extreme tips of the semi-circular ends 2*a* of the claws 1 contacting the photoreceptor surface 35*a* of the drum 35. In this state, the the leading edge of the copy paper 42 reaches a portion of the photoreceptor surface 35*a*, whereat the tips of the claws 1 contact the latter, for being separated from the photoreceptor surface 35*a* and for subsequently being guided by the guide rollers 43 and fed into a developing unit(not shown) through a pair of transportation rollers 54.

When the cam plate 21 has made one rotation upon completion of separation of the copy paper 42, the actuator pin 23 of the cam plate 21 depresses the second adjusting plate 46 for rotating the latter counterclockwise to a certain extent together with the shaft 41 and the claws 1. The claws 1 are thus spaced away from the photoreceptor surface 35*a* of the drum 35.

It is to be noted here that the separating claws 1 described as provided at three points on the shaft 41 in the direction parallel to the width of the photoreceptor drum 35 may be replaced by one claw provided at the central portion of the shaft 41, or the number of claws 1 may be increased to more than three, depending on the requirements.

As is seen from the foregoing description, according to the transfer material separating device of the embodiment of FIGS. 1 to 6, since each of the separating claws is formed from flexible elastic material, such as polyester film, with very short fibers of flexible material, for example, of nylon and the like being filled at least on the forward end portion of the claw, such a claw closely contacts the photoreceptor surface gently for efficient separation of the copy paper sheets. If a plurality of such claws are provided in parallel relation to each other for simultanous functioning, pressure acting upon the photoreceptor surface can advantageously be shared by each of the claws through elasticity of the latter. Furthermore, since the extreme tip of the claw is also filled with the very short fibers, direct contact of the flexible elastic material such as the polyester film of the claw with the photoreceptor surface can be avoided. According to a series of experiments carried out by the present inventors, no damage which can possibly adversely affect the copied images is noticed even after copying of 10,000 copy paper sheets in the latent image transfer type photoreceptor, and thus it is confirmed that the device of the invention is best suited to the photoreceptor of such types.

It is another advantage of the separating device of the invention that, since one solenoid is utilized for combined purposes i.e., for controlling the stop member of the platform and also for controlling the function of the separating claws, provision of another separate solenoid is unnecessary. Consequently, particular energization of such a separate solenoid exclusively for the separating claws during scanning of the platform is not required, thus preventing any undesirable rocking motion or vibration of the platform.

Figure 7:
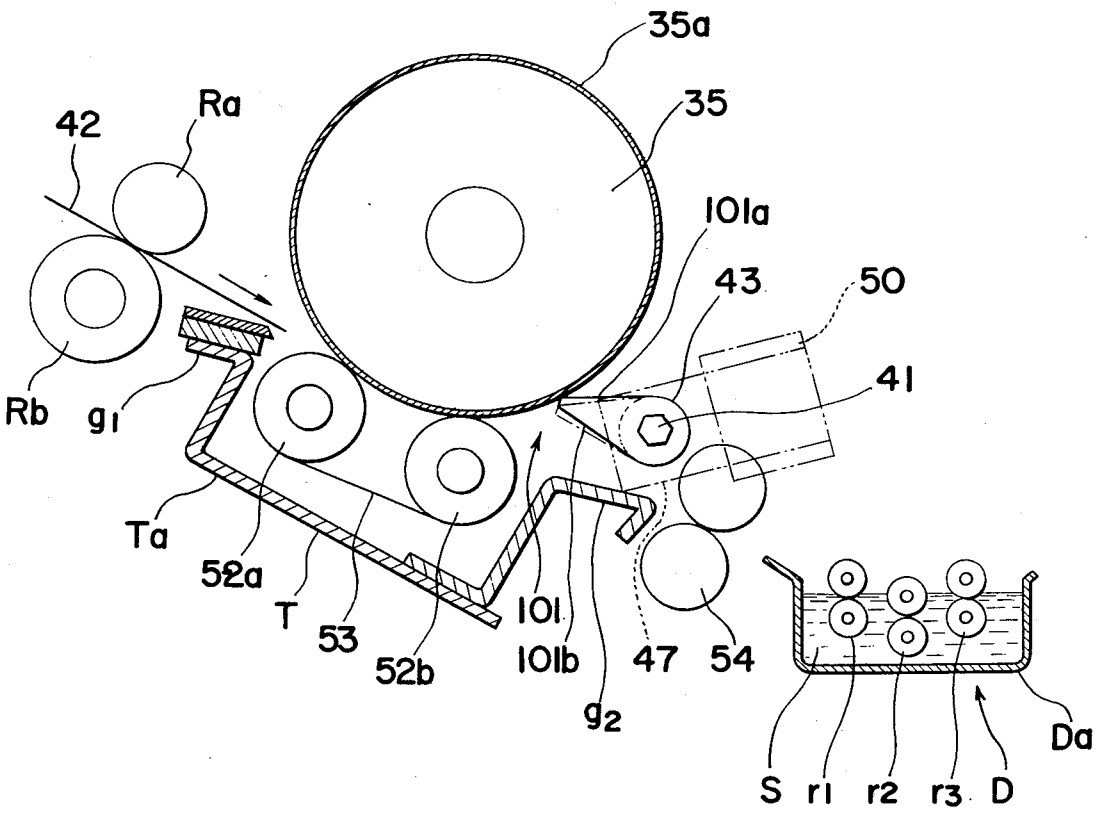
FIG. 7 is a similar view to FIG. 6, but particularly shows a modification of the separating claw of FIG. 6.

Referring now to FIG. 7, there is shown a modification of the transfer material separating claw 1 of the embodiment of FIGS. 1 to 6. Since the construction and function of the photoreceptor drum, the transfer unit T including transportation rollers and the driving mechanism for the separating claws are the same as those in the embodiment of FIGS. 1 to 6 except for construction of the separating claws and inclusion of a developing device D of wet type, the detailed description thereof is abbreviated.

In the modification of FIG. 7, the separating claw 1 described as employed in the embodiment of FIGS. 1 to 6 is replaced by a separating claw 101. The separating claw 101 is fixedly mounted on the shaft 41 at the central portion of the latter facing the photoreceptor surface 35*a* and has an upper layer 101*a*, for example, of polyurethane rubber corresponding to the photoreceptor surface 35*a*, and an lower surface 101*b* coated, for example, with Teflon(commercial name for polytetrafluoruethylene product by Du Pont) which contacts the copy paper 42 subsequent to separation. The separating claw 101 fixedly mounted on the shaft 41 is rotated from the spaced position shown by a dotted line to the separating position whereat the tip of the claw 101 contacts the photoreceptor surface 35*a* for a required period of time in the similar manner to that detailed with reference to the embodiment of FIGS. 1 to 6. The copy paper 42 separated from the photoreceptor surface 35*a* and bearing thereon the latent image transferred at the transfer unit T is subsequently fed into the developing tank Da of the developing unit D in which a plurality of pairs of developing rollers $r_1$, $r_2$ and $r_3$ are sequentially and rotatably provided for developing the latent image of negative polarity on the copy paper 42 in developing solution s containing therein toner of positive polarity.

It should be noted here that the substance forming the portion 101*a* of the claw 101 which contacts the photoreceptor surface 35*a* is not limited to the polyurethane gum, and any other flexible elastic materials may be employed so long as such materials are suited for reducing damage to the photoreceptor surface even following repeated contact thereof with the photoreceptor surface.

It should also be noted that the material forming the portion 101*b* of the claw 101 which contacts the copy paper 42 is not limted to Teflon and may be replaced by any other materials which are tribo-electrically charged by the contact with the copy paper to the same polarity as that of the latent image formed on the copy paper.

By the above arrangement, the copy paper 42 fed through the rollers R*a* and R*b* and the guide plate $g_1$ is caused to contact the photoreceptor surface 35*a* by the insulating roller 52*a* and is subsequently pressed closely against the latter by the insulating belt 53 and the electrically conductive grounded roller 52*b* for transferring the latent image of negative polarity formed on the photoreceptor surface 35*a* onto the copy paper 42. In this case, the latent image transferred on the copy paper 42 is also of negative polarity. Immediately before the leading edge of the copy paper 42 reaches the roller 52*b* of the transfer unit T, the separating claw 101 is turned to contact the photoreceptor surface 35*a* for stripping the leading edge of the copy paper 42 electrostatically attracted onto the surface 35*a* off the same surface 35*a*. The copy paper 42 is subsequently guided by the lower surface 101*b* of the claw 101 and the guide plate $g_2$ into a developing tank D*a* of the developing device D through the roller 43 and the rollers 54, whereat the latent image on the copy paper 42 is developed into a visible toner image by the application of developing solution S which contains toner of positive polarity dispersed therein as the copy paper 42 is passed through the plurality of pairs of developing rollers $r_1$, $r_2$ and $r_3$.

It is to be noted here that, since the lower surface 101*b* of the separating claw 101 is coated with Teflon, the background portion of the latent image on the copy paper 42 is charged with positive polarity owing to charging sequence when the high resistant resinous surface layer of the copy paper 42 contacts the lower surface 101*b* of the claw 101, thus no traces of such contact appear on the copied images developed subsequently at the developing unit D by the developing solution S containing toner of positive polarity therein.

Furthermore, since the upper portion 101*a* of the claw 101 which contacts the photoreceptor surface 35*a* is of polyurethane rubber, damage to the photoreceptor surface 35*a* is markedly reduced as compared with separating claws composed only of Teflon.

Figure 8:
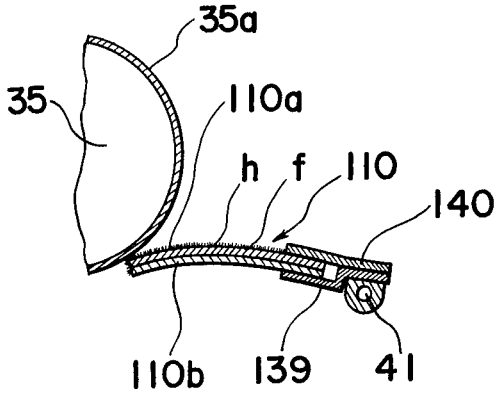
FIG. 8 is a similar view to FIG. 7, but particularly shows another modification of the separating claw of FIG. 6.

Referring to FIG. 8, there is shown another modification of the separating claw 1 of the embodiment of FIGS. 1 to 6. In this modification, the separating claw 110 tightly held, at the rear portion thereof, between a guide plate 140 and a support plate 139 fixedly mounted on the shaft 41 comprises an upper portion 110*a* contacting the photoreceptor surface 35*a* and made of a flexible film *f*, for example, of polyester, on the surface of which floxk or short fibers *h* of nylon or polyester are filled, and a lower portion 110*b* coated with Teflon as in the modification of FIG. 7. Since the upper portion 110*a* of the claw 110 which contacts the photoreceptor surface 35*a* is filled with short fibers *h*, for example, by electrostatic flocking as in the embodiment of FIGS. 1 to 6, damage to the photoreceptor surface 35*a* by the claw can further be reduced as compared with the claw 101 of the modification of FIG. 8 in addition to the favourable effect of the Teflon coating at the lower surface thereof.

It should be noted here that, although description is made with reference to separating claws for use in transfer type copying apparatus employing the N type photoreceptor in the modifications of FIGS. 7 and 8, the lower portion of the separating claw contacting the copy paper must be one which charges the latent image background portion on the copy paper to a negative polarity in the case of a transfer type copying apparatus employing P type photoreceptor. In that case, acryl, polyester, Mylar(commercial name for polyethylene glyco, terephthalate film produced by Du Pont), Derlin(commercial name for acetal resin product produced by Du Pont), etc. are suitable for material of the lower portion of the separating claw contacting the copy paper.

It should also be noted, however, that materials suitable for the lower portion of the separating claw which contacts the copy paper are different, depending on the kinds of insulating dielectric coating on the copy paper. Such materials should therefore be selected according to the kinds of the coating on the copy paper.

As is clear from the foregoing description, according to the modifications of FIGS. 7 and 8, the upper portion of the separating claw which contacts the photoreceptor surface is made of flexible elastic material, and the lower portion thereof, which frictionally contacts the copy paper is composed of material that is to be tribo-electrically charged with the same polarity as the latent image on the copy paper due to friction therebetween. Not only is damage to the photoreceptor surface by the separating claw markedly reduced, but charging of the latent image background portion on the copy paper with the same polarity as that of the latent image due to tribo-electrical charging of the separating claw is eliminated. Thus, the appearance of the contact traces by the separating claw on the copied images is advantageously prevented.

Although the present invention has been fully described by way of example with reference to the attached drawings, it is to be noted that various changes and modifications are apparent to those skilled in the art. For example, the transfer material separating device of the invention mainly described with reference to the copying apparatus having a movable platform with a stationary optical system in the foregoing description is readily applicable to a copying apparatus with a movable optical system and a stationary platform or to any other types of copying apparatus wherein separation of copy papers are required, through minor alterations in the associated mechanisms. Therefore, unless such changes and modifications depart from the scope of the present invention, they should be construed as included therein.

Further, it should be noted that the separating claw member of the invention remarkably minimizes the damage to the photoreceptor surface; therefor, contacting means for causing said separating claw member to contact to the photoreceptor surface need not selectively cause said separating claw member to contact and to space from the photoreceptor surface, and may always cause said separating claw member to contact to the photoreceptor surface.

What is claimed is:

1. A transfer material separating device for use in an electrophotographic copying apparatus having:

a platform for supporting thereon an original object to be copied;

an optical system beneath said platform for optically transferring the image of said object on said platform; and a rotatable photoreceptor having a photoconductive surface for receiving the image from said optical system and for contacting and transferring said image to said transfer material, said separating device comprising:

separating claw member means adjacent and at least intermittently contacting said photoreceptor for separating said transfer material from said photoconductive surface after said image is transferred to said transfer material, said claw member means having a semi-circular shaped front portion contacting said photoconductive surface, said front portion having short fibers of flexible material thereon; and contacting means operatively connected to said claw member means for causing said claw member means to contact said photoconductive surface.

2. A transfer material separating device as claimed in claim 1, wherein said photoreceptor is in a configuration of a drum having the photoconductive surface therearound.

3. A device as claimed in claim 1, wherein said short fibers of flexible material are comprised of nylon.

4. A device as claimed in claim 1, wherein said short fibers of flexible material are comprised of polyester.

5. A device as claimed in claim 1, wherein said separating claw member means is comprised of flexible, elastic material having said short, flexible fibers on at least the end portion thereof.

6. A device as claimed in claim 1, wherein said separating claw member means is comprised of a polyester film having said short flexible fibers on at least the end portion thereof.

7. A device as claimed in claim 1, wherein said separating claw member means is a plurality of separating claw member means connected to said contacting means and arranged parallel to each other across the width of said photoconductive surface.

8. A device as claimed in claim 1, wherein the movement of said contacting means causing said claw member means to contact said photoconductive surface is synchronized with the movement of said transfer material and causes said claw member means to contact said photoconductive surface upon the arrival of the leading edge of said transfer material at a predetermined separating position on said photoreceptor surface.

9. A device as claimed in claim 8, wherein said platform is reciprocally movable for scanning said original thereon;

wherein said optical system is stationary; and further comprising lock releasing means connected to said contacting means and said platform for releasing said platform for movement and for releasing said contacting means to move said claw member means toward said photoconductive surface.

10. A device as claimed in claim 8, wherein said optical system is reciprocally movable for scanning said original on said platform;

wherein said platform is stationary; and further comprising lock releasing means connected to said contacting means and said optical system for releasing said optical system for movement and for releasing said contacting means to move said claw member means toward said photoconductive surface.

11. A device as claimed in claim 1, wherein the image formed on said photoconductive surface is directly transferred without developing onto said transfer material; and said claw member means is formed at the portion thereof contacting said transfer material from tribo-electrically charged material having the same polarity as the image transferred on to said transfer material as a result of the friction between said transfer material on said portion of said claw member means contacting said transfer material.

12. A device as claimed in claim 1, wherein the entire end surface portion of said claw member means having said short fibers of flexible material thereon contacts said photoconductive surface in a direction parallel to the axial direction of said photoreceptor.

* * * * *